US006968703B2

(12) United States Patent
Warren

(10) Patent No.: US 6,968,703 B2
(45) Date of Patent: Nov. 29, 2005

(54) MECHANICAL FREEZER

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 102 days.

(21) Appl. No.: 10/644,905

(22) Filed: Aug. 21, 2003

(65) Prior Publication Data

US 2005/0039466 A1 Feb. 24, 2005

(51) Int. Cl.[7] ..... F25B 9/00
(52) U.S. Cl. ..... 62/6
(58) Field of Search ..... 62/6; 60/517–522

(56) References Cited

U.S. PATENT DOCUMENTS

| | | | | |
|---|---|---|---|---|
| 1,440,150 | A | 12/1922 | Hutchinson | |
| 2,616,244 | A * | 11/1952 | Veldhuyzen | 60/521 |
| 3,698,182 | A * | 10/1972 | Knoos | 62/6 |
| 3,928,974 | A | 12/1975 | Benson | |
| 4,041,708 | A | 8/1977 | Wolff | |
| 4,044,558 | A | 8/1977 | Benson | |
| 4,207,748 | A | 6/1980 | Nebgen | |
| 4,444,024 | A | 4/1984 | McFee | |
| 4,490,974 | A | 1/1985 | Colgate | |
| 4,697,420 | A | 10/1987 | Ishiki et al. | |
| 4,753,073 | A | 6/1988 | Channdler | |
| 4,984,432 | A | 1/1991 | Corey | |
| 5,209,065 | A | 5/1993 | Sakata | |
| 5,335,506 | A * | 8/1994 | Byoung-Moo | 62/6 |
| 5,465,579 | A * | 11/1995 | Terada et al. | 62/6 |
| 5,485,726 | A * | 1/1996 | Shin et al. | 60/519 |
| 5,927,080 | A | 7/1999 | Lee | |
| 6,116,222 | A * | 9/2000 | Warren | 123/543 |
| 6,199,520 | B1 * | 3/2001 | Warren | 123/48 R |
| 6,530,211 | B2 | 3/2003 | Holttzapple et al. | |
| 6,799,563 | B1 * | 10/2004 | Warren | 123/543 |

* cited by examiner

*Primary Examiner*—Denise L. Esquivel
*Assistant Examiner*—Richard L. Leung

(57) ABSTRACT

The Mechanical Freezer of this invention closely approaches an ideal freezer cycle composed of constant temperature compression, expansion, and constant volume heating (load transfer) by using power piston 106 that power input shaft 50 moves up and down and displacers 104 and 105 that are moved by cam 108. When power piston 106 moving up and additional displacer 105 moving down come together, fluid is forced through additional heat sink 41 where it is cooled as it is compressed. When additional displacer 105 and primary displacer 104 come together, fluid is forced through primary heat sink 40 where it is cooled as it is compressed. After compression, the cooled fluid is expanded by power piston 106 along with displacers 104 and 105 moving down. When displacers 104 and 105 then move up, fluid is forced through load 30 and load 30 is cooled.

7 Claims, 8 Drawing Sheets

MECHANICAL FREEZER

BACKGROUND—FIELD OF INVENTION

The present invention relates to a reciprocating, two-stroke mechanical freezer with one piston moving in with a sinusoidal motion and one or more displacer pistons moving in non-sinusoidal motion so that it obtains cooled compression.

BACKGROUND—DESCRIPTION OF PRIOR ART

The Mechanical Freezer is one of the more efficient of the practical freezer cycles, but the past mechanization of the Mechanical Freezer relied on two pistons operating with sine wave motion. An example of this is Ishiki et al (1987, U.S. Pat. No. 4,697,420). The cycle produced by this arrangement deviates from a true constant temperature compression. Another inventor has used a cam to move a secondary piston, but that was in an internal combustion engine C. H. Hutchinson (1922, U.S. Pat. No. 1,440,150).

SUMMARY

The Mechanical Freezer cycle is composed of three processes. A constant temperature compression process, an expansion process, and a constant volume heating process (heat transfer from the load). The Mechanical Freezer of this invention closely approaches that ideal cycle by using power piston 106 and displacers 104 and 105. Power piston 106 is moved up and down by power input shaft 50. Displacers 104 and 105 are moved up and down by cam 108. When power piston 106 moving up and additional displacer 105 moving down come together, fluid is forced through additional heat sink 41 where it is cooled as it is compressed. When additional displacer 105 and primary displacer 104 come together, fluid is forced through primary heat sink 40 where it is cooled as it is compressed. After compression, the cooled fluid is expanded by power piston 106 along with displacers 104 and 105 moving down. When displacers 104 and 105 then move up, fluid is forced through load 30 and load 30 is cooled.

OBJECTS AND ADVANTAGES

The advantage of the Mechanical Freezer is that it can cool the working fluid very efficiently because the cooled compression can approach constant temperature compression by using many additional compressors.

DRAWING FIGURES

Figure 1:
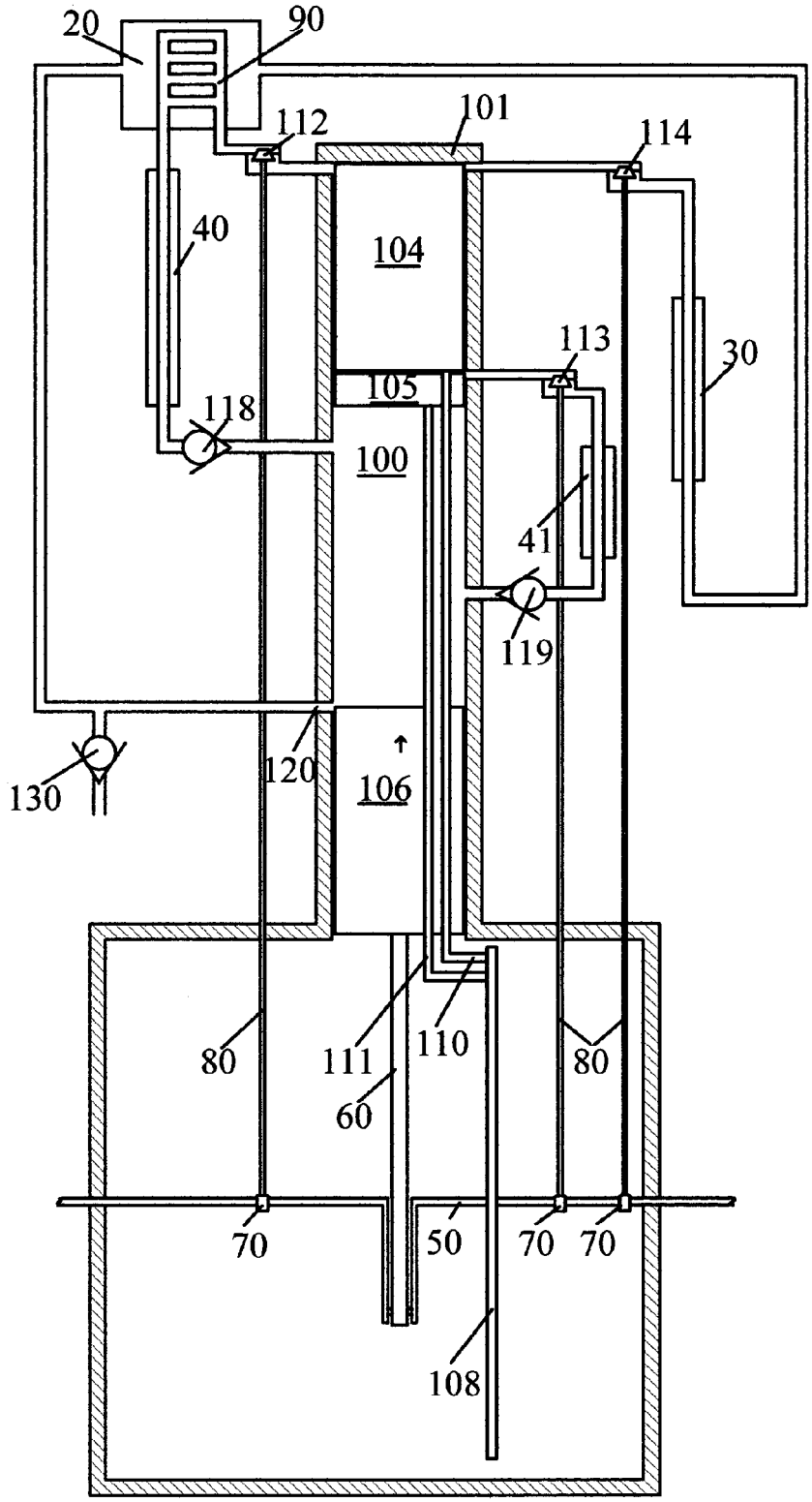
FIG. 1 shows the preferred embodiment of the freezer at the end of the heating process (cooling of the load), and at the start of the additional compression process.

REFERENCE NUMERALS IN DRAWINGS heat exchanger low-pressure side 20
load 30
primary heat sink 40
additional heat sink 41
power input shaft 50
connecting rod 60
valve cams 70
push rods 80
heat exchanger high-pressure side 90
cylinder 100
cylinder head 101
primary displacer 104
additional displacer 105
power piston 106
cam 108
primary cam follower 110
additional cam follower 111
primary isolation valve 112
additional isolation valve 113
load isolation valve 114
primary inlet valve 118
additional inlet valve 119
fluid inlet port 120
pressurizing valve 130.

Description—FIGS. 1 to 4—Preferred Embodiment

The preferred embodiment of the invention employs a two-stroke cycle divided into three processes. The first is the cooled compression process, the second is the expansion process, and the third is the heating process (cooling of the load). The heating process (cooling of the load) is heat addition at constant volume, and is the where the load gets cold.

The cooled compression process starts at about 15% of the travel up of power piston 106 and ends with power piston 106 at about top dead center. The expansion process starts with power piston 106 at about top dead center and ends at about 85% of the downward travel of power piston 106. The heat addition at constant volume process starts at about 85% of the downward travel of power piston 106 and ends at about 15% of the travel back up of power piston 106. The cooled compression process can be divided into many parts. FIGS. 1 to 4 show it divided into two parts the additional compression and the primary compression. The additional compression part starts at starts at about 15% of the travel up of power piston 106 and ends at about 50% of the travel up of power piston 106. The primary compression part starts at about 50% of the travel up of power piston 106 and ends with power piston 106 at about top dead center.

The above positions are all estimates and are given for descriptive purposes only. The actual position a process of the cycle may begin or end at may be different from those set out above. In addition, because primary displacer 104 does not operate sinusoidally, one process can be longer than another.

Cylinder 100 contains cylinder head 101, power piston 106, primary displacer 104, and additional displacer 105. Power piston 106 is driven with a sinusoidal motion through connecting rod 60 by power input shaft 50. Primary displacer 104 is driven through primary cam follower 110 by cam 108. Additional displacer 105 is driven through additional cam follower 111 by cam 108. The up and down motion of primary displacer 104 and additional displacer 105 is determined by the shape of the grooves in cam 108. Load 30 transfers cold out to a load not shown. Power input shaft 50 transfers work into the freezer from a power source not shown. Pressurizing valve 130 allows the complete engine to be pressurized.

Attached to cylinder 100 are three paths. The load path contains load isolation valve 114, load 30, heat exchanger low-pressure side 20, and fluid inlet port 120. The primary path contains primary inlet valve 118, primary heat sink 40, heat exchanger high-pressure side 90, and primary isolation valve 112. The additional path contains additional inlet valve 119, additional heat sink 41, and additional isolation valve 113.

Primary inlet valve 118 and primary isolation valve 112 isolate primary heat sink 40 from cylinder 100 during part of the cycle. Additional isolation valve 113 and additional inlet valve 119 isolate additional heat sink 41 from cylinder 100 during part of the cycle. Load isolation valve 114 and fluid inlet port 120 isolate load 30 from cylinder 100 during part of the cycle. Valve cam 70 and push rod 80 operate primary isolation valve 112, additional isolation valve 113, and load isolation valve 114 from power input shaft 50.

The primary displacer 104, along with primary cam follower 110, a groove in cam 108, primary heat sink 40, primary isolation valve 112, and primary inlet valve 118 make up the primary compressor. The additional displacer 105, along with additional cam follower 111, a groove in cam 108, additional heat sink 41, additional isolation valve 113, and additional inlet valve 119 make up an additional compressor. As many of these additional compressors as desired can be added to give intercooled compression approaching constant temperature compression.

The working fluid could be air or any gas or mixture of gases. The fluid in the system can be maintained at any pressure through pressurizing valve 130.

Operation—FIGS. 1 to 4—Preferred Embodiment

FIGS. 1 to 4 present the sequence of steps or processes occurring in the preferred embodiment of the freezer. The additional cooled compression process takes place between FIGS. 1 and 2. The primary cooled compression process takes place between FIGS. 2 and 3. The expansion process takes place between FIGS. 3 and 4. The heating process (cooling of the load) takes place between FIGS. 4 and 1.

FIG. 1 shows: Cylinder 100 about to start the additional cooled compression process. Primary displacer 104 and additional displacer 105 are at the top of cylinder 100. Power piston 106 is at about 15% of its upward travel. Primary isolation valve 112 is closed, Additional isolation valve 113 is closed, load isolation valve 114 is closed, primary inlet valve 118 is closed, additional inlet valve 119 is closed, and fluid inlet port 120 is covered.

Figure 2:
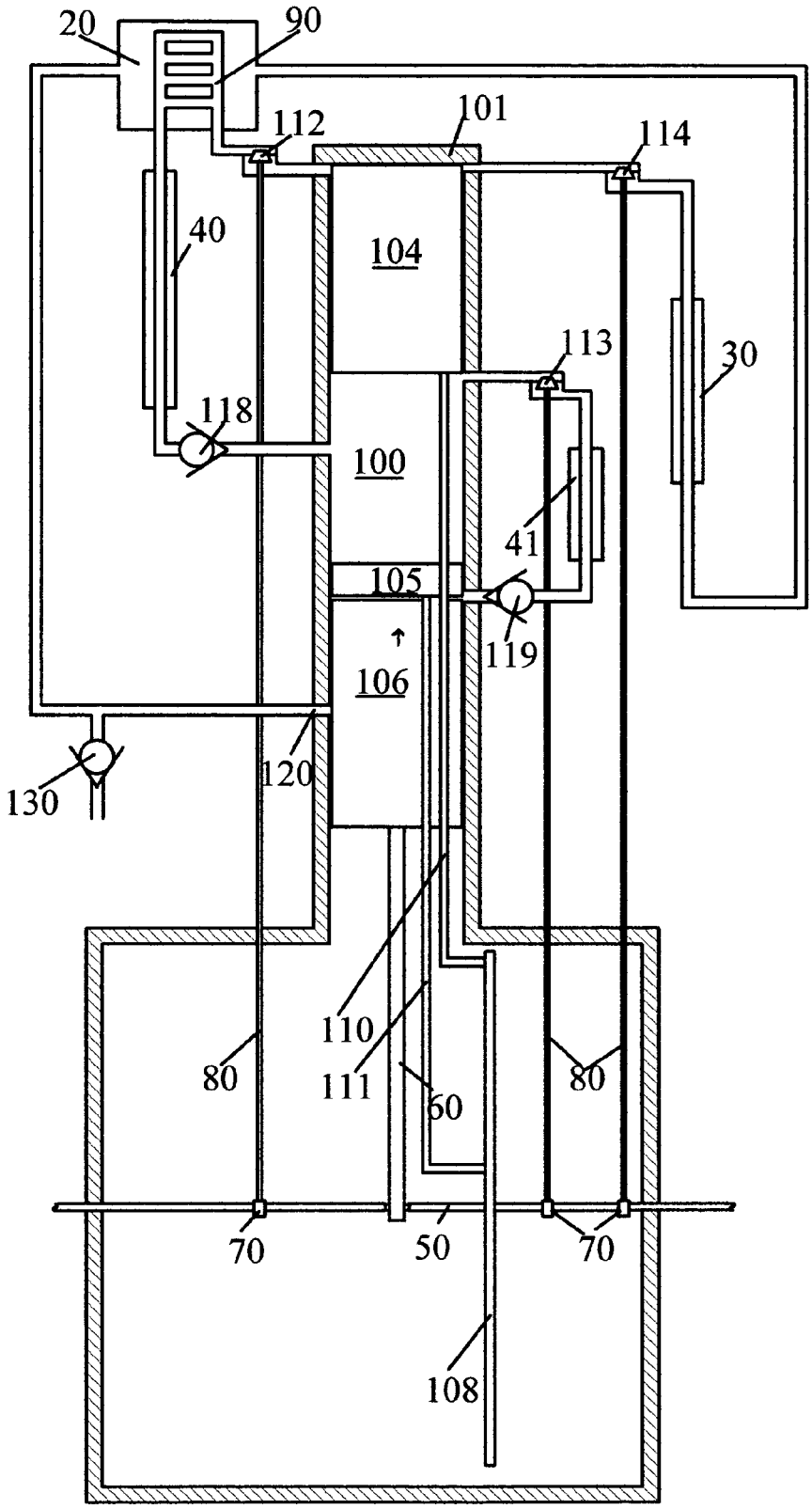
FIG. 2 shows the preferred embodiment of the freezer at the end of the additional compression process, and at the start of the primary compression process.

Between FIG. 1 and FIG. 2 additional cooled compression takes place. Additional isolation valve 113 opens, and when the pressure builds up between additional displacer 105 and power piston 106, additional inlet valve 119 opens. Additional displacer 105 is moved down by cam 108 to the top of power piston 106. As additional displacer 105 moves down and power piston 106 moves up, fluid is forced through additional heat sink 41 and is cooled as it is compressed into the space above additional displacer 105. Additional isolation valve 113 and additional inlet valve 119 close.

FIG. 2 shows: Cylinder 100 about to start the primary cooled compression process. Primary displacer 104 is at the top of cylinder 100, and additional displacer 105 is at the top of power piston 106. Power piston 106 is at about 50% of its upward travel. Primary isolation valve 112 is closed, Additional isolation valve 113 is closed, load isolation valve 114 is closed, primary inlet valve 118 is closed, additional inlet valve 119 is closed, and fluid inlet port 120 is covered.

Figure 3:
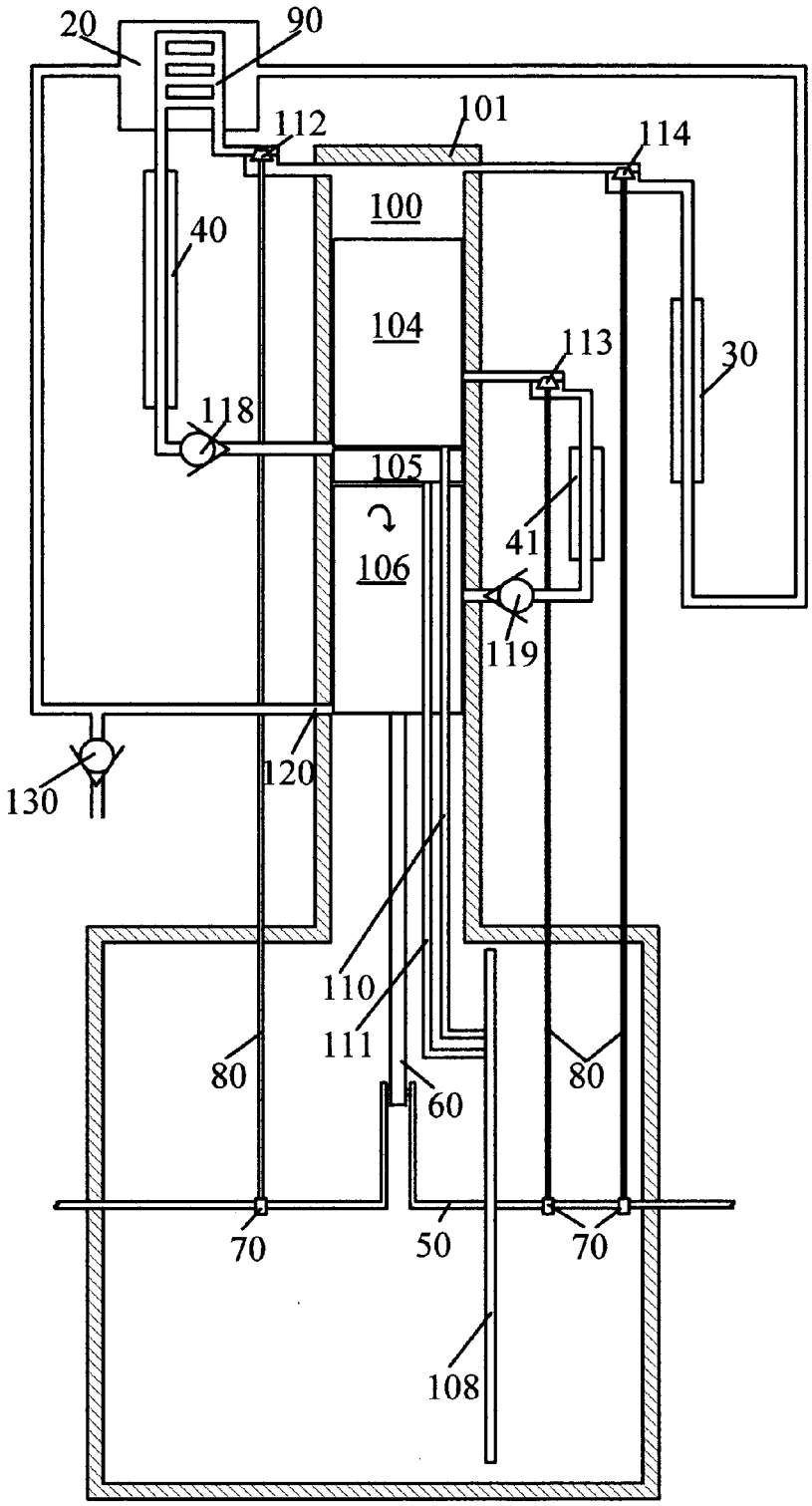
FIG. 3 shows the preferred embodiment of the freezer at the end of the primary compression process, and at the start of the expansion process.

Between FIG. 2 and FIG. 3 primary cooled compression takes place. Primary isolation valve 112 opens, and when the pressure builds up between primary displacer 104 and additional displacer 105, primary inlet valve 118 opens. Primary displacer 104 is moved down by cam 108 to the top of additional displacer 105. As primary displacer 104 moves down and power piston 106 moves up, fluid is forced through primary heat sink 40 and heat exchanger high-pressure side 90 and cooled as it is compressed into the space above primary displacer 104. Primary isolation valve 112 and primary inlet valve 118 close.

FIG. 3 shows cylinder 100 about to start the expansion process. Primary displacer 104 and additional displacer 105 are at the top of power piston 106, and power piston 106 is at about top dead center. Primary isolation valve 112 is closed, additional isolation valve 113 is closed, load isolation valve 114 is closed, primary inlet valve 118 is closed, additional inlet valve 119 is closed, and fluid inlet port 120 is covered.

Figure 4:
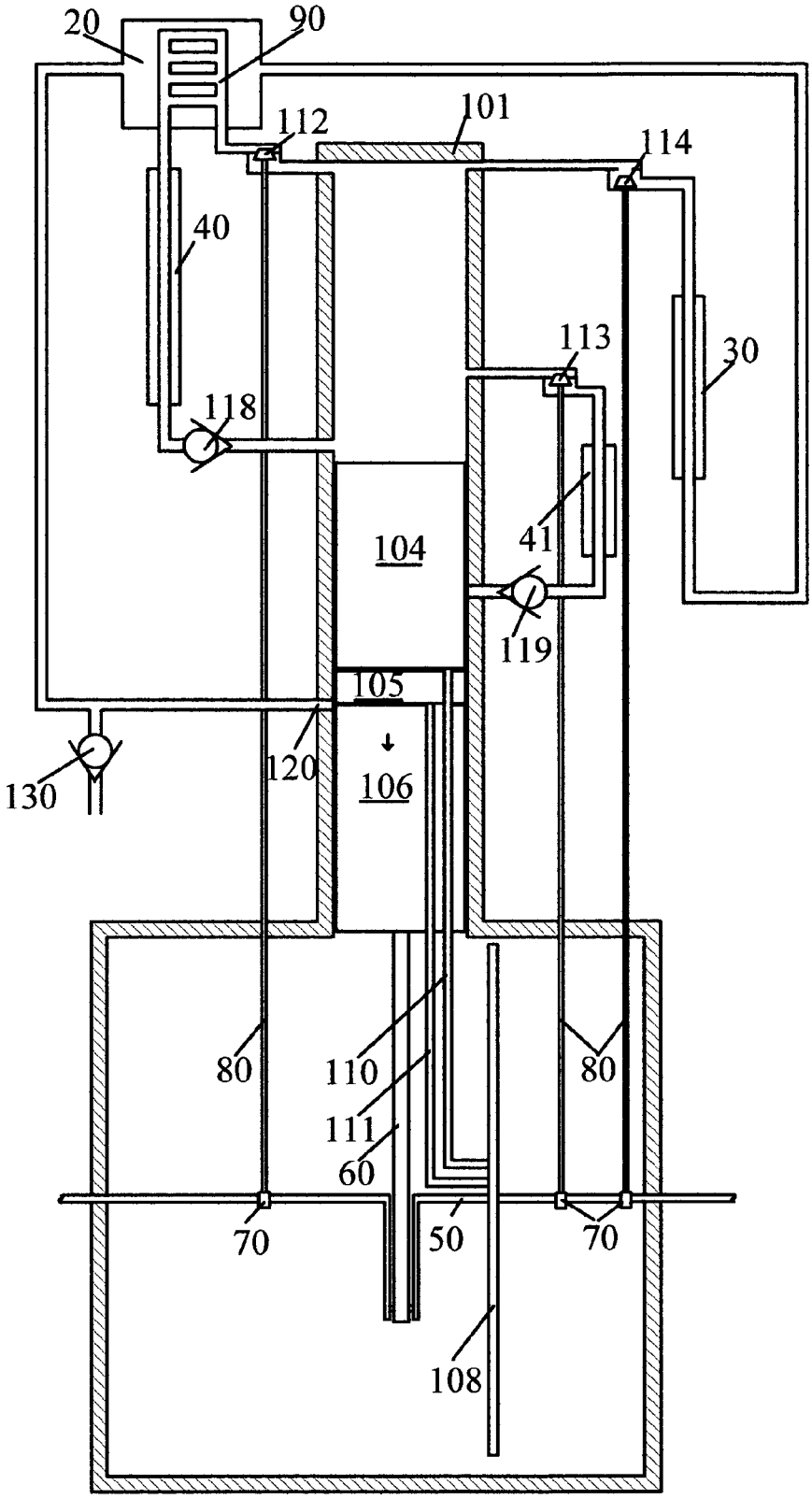
FIG. 4 shows the preferred embodiment of the freezer at the end of the expansion process, and at the start of the heating process (cooling of the load).

Between FIG. 3 and FIG. 4 the expansion process takes place. Primary displacer 104, additional displacer 105, and power piston 106 move down together. Primary displacer 104 and additional displacer 105 are moved down by cam 108, and power piston 106 is moved down by power input shaft 50. Load isolation valve 114 opens.

FIG. 4 shows cylinder 100 about to start the heating process (cooling of the load). Primary displacer 104 and additional displacer 105 are on top of power piston 106, and power piston 106 is at about 85% of its downward travel. Primary isolation valve 112 is closed, additional isolation valve 113 is closed, load isolation valve 114 is open, primary inlet valve 118 is closed, and fluid inlet port 120 is covered.

Between FIG. 4 and FIG. 1 the heating process (cooling of the load) takes place. Fluid inlet port 120 is uncovered. Primary displacer 104 and additional displacer 105 are moved up by cam 108 to the top of cylinder 100. As primary displacer 104 and additional displacer 105 move up fluid is forced through load 30 and heated by heat coming from the load (cooling the load). It continues on through heat exchanger low-pressure side 20 and primary heat sink 40 back into cylinder 100. Power piston 106 is moved down and back up to about 15% of its upward travel by power input shaft 50.

Figure 5:
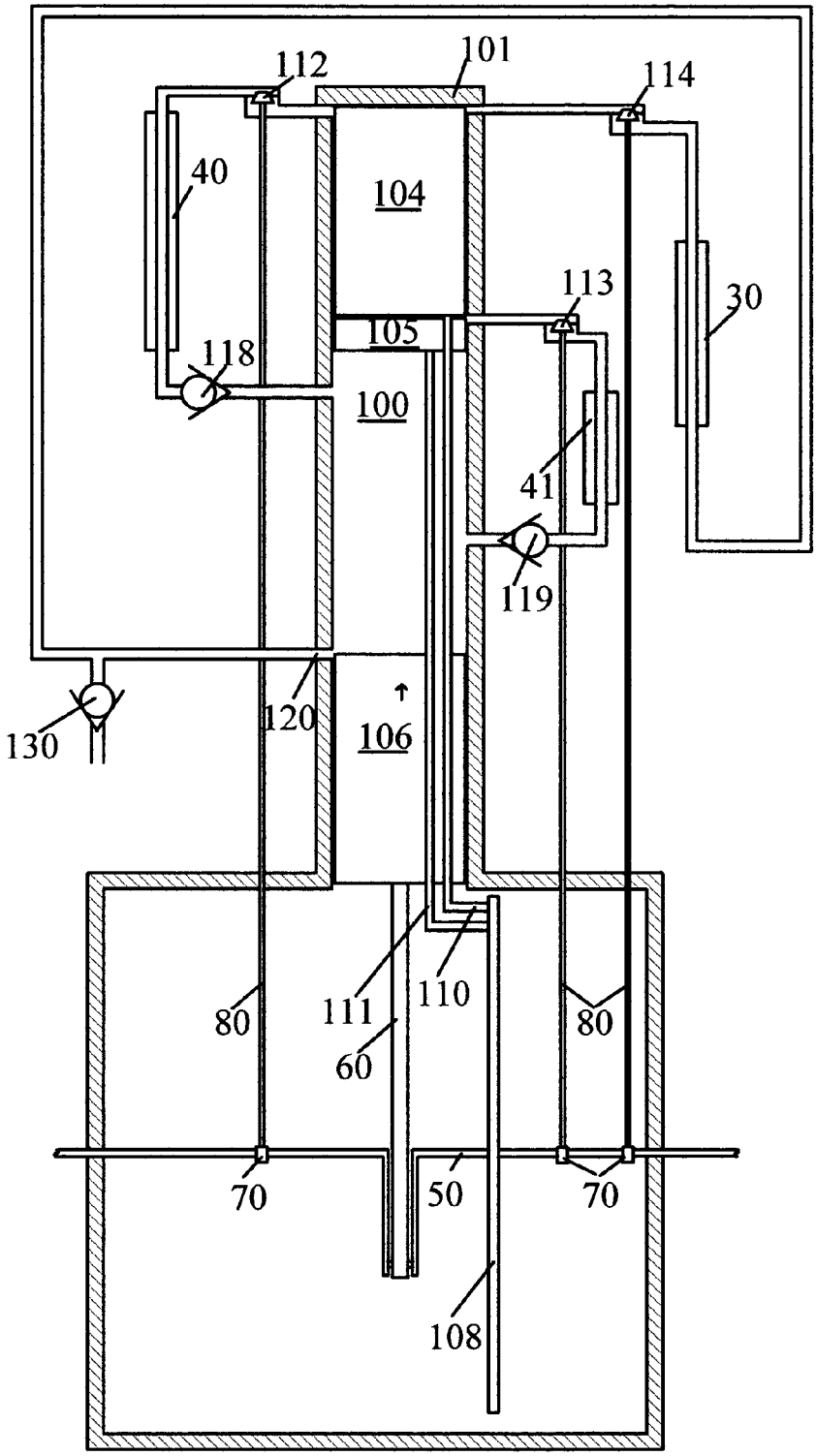
FIG. 5 shows the first alternate embodiment of the freezer at the end of the heating process (cooling of the load), and at the start of the additional compression process.

Description—FIG. 5—First Alternate Embodiment

The first alternate embodiment of the freezer is the same as the preferred embodiment without heat exchanger low-pressure side 20 and heat exchanger high-pressure side 90.

Figure 6:
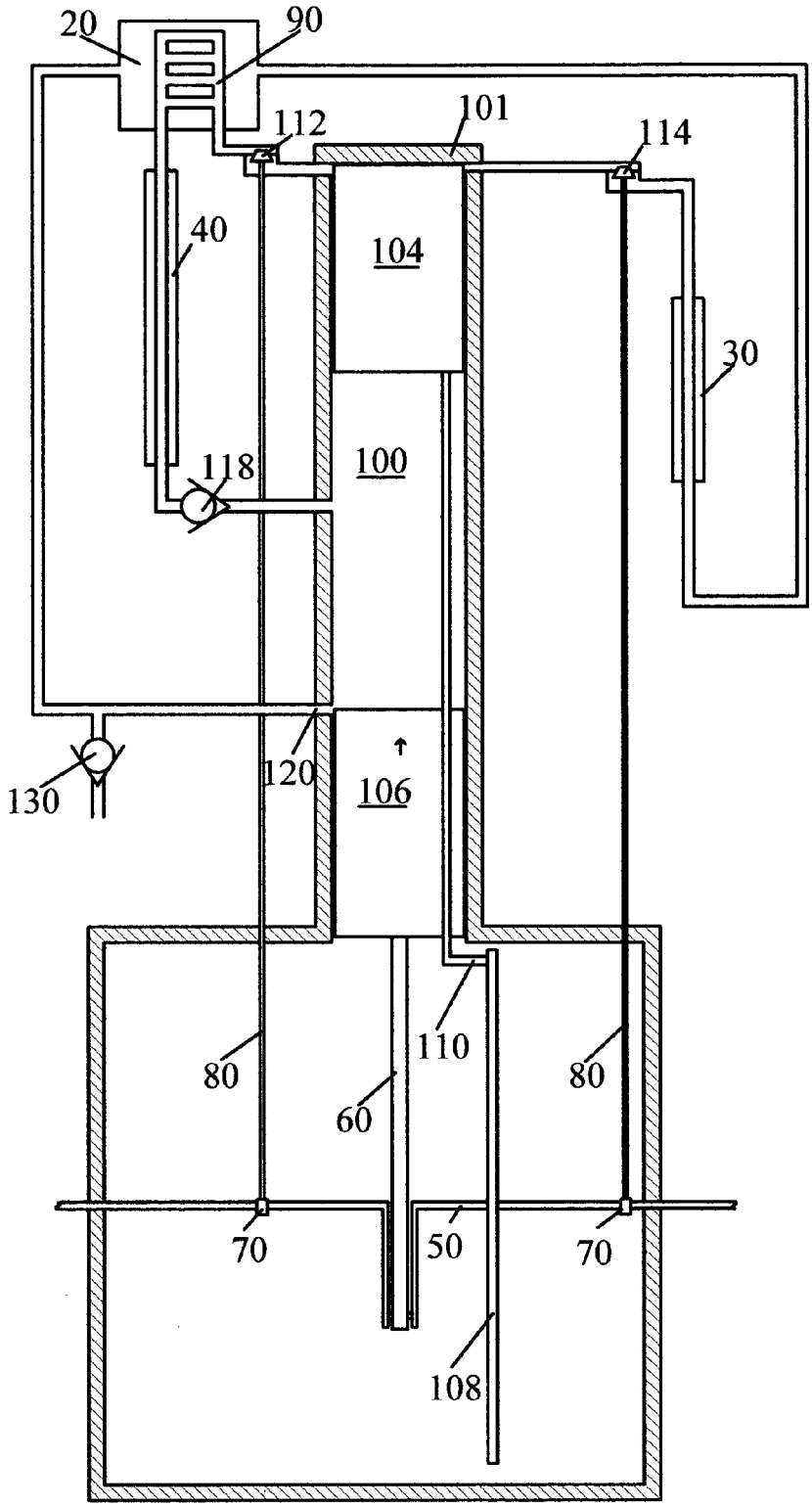
FIG. 6 shows the second alternate embodiment of the freezer at the end of the heating process (cooling of the load), and at the start of the primary compression process.

Description—FIG. 6—Second Alternate Embodiment

The second alternate embodiment of the freezer is the same as the preferred embodiment without the additional compressor. The additional compressor contains additional displacer 105, along with additional cam follower 111, a groove in cam 108, additional heat sink 41, additional isolation valve 113, and additional inlet valve 119.

Figure 7:
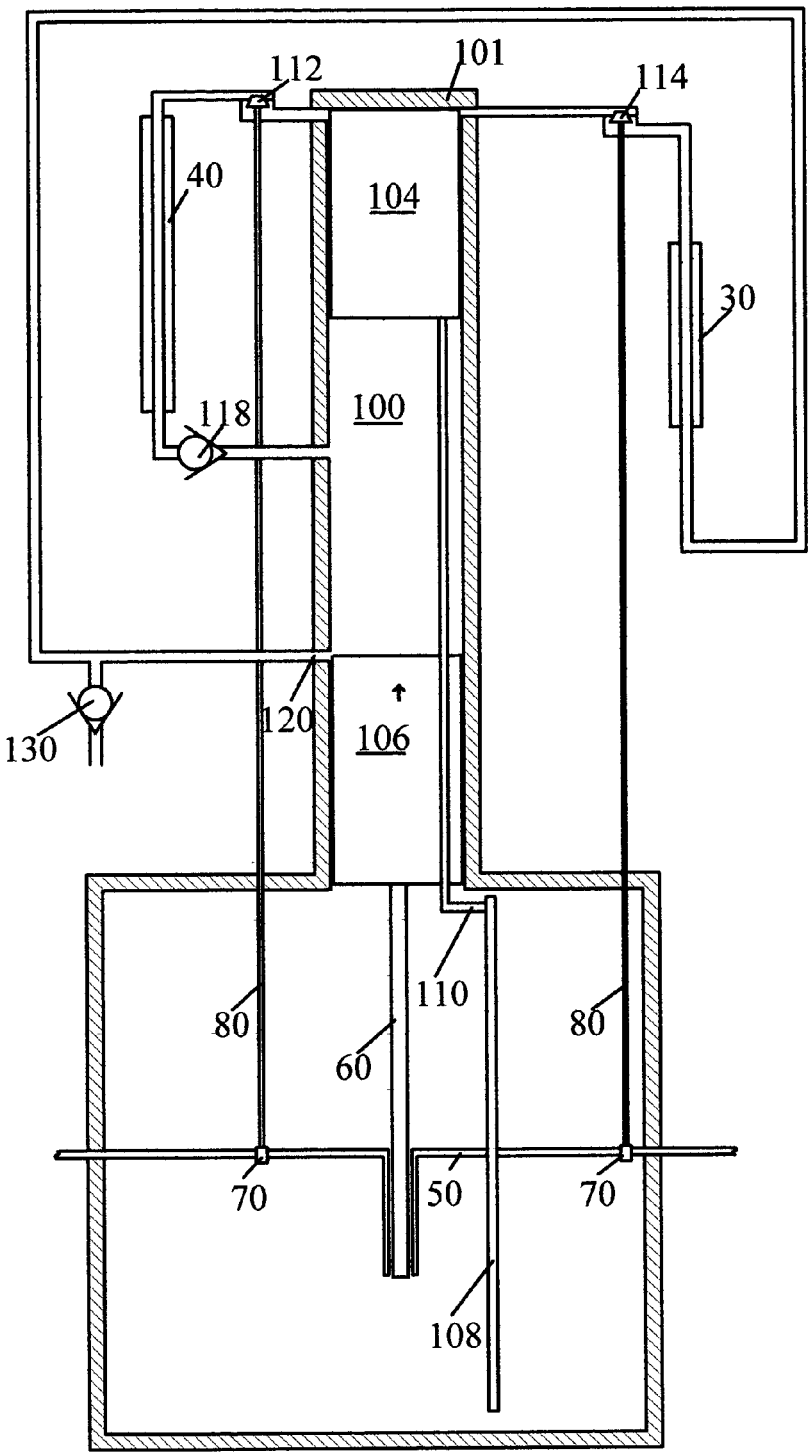
FIG. 7 shows the third alternate embodiment of the freezer at the end of the heating process (cooling of the load), and at the start of the primary compression process.

Description—FIG. 7—Third Alternate Embodiment

The third alternate embodiment of the freezer is the same as the preferred embodiment without heat exchanger low-pressure side 20, heat exchanger high-pressure side 90, and the additional compressor. The additional compressor contains additional displacer 105, along with additional cam follower 111, a groove in cam 108, additional heat sink 41, additional isolation valve 113, and additional inlet valve 119.

Figure 8:
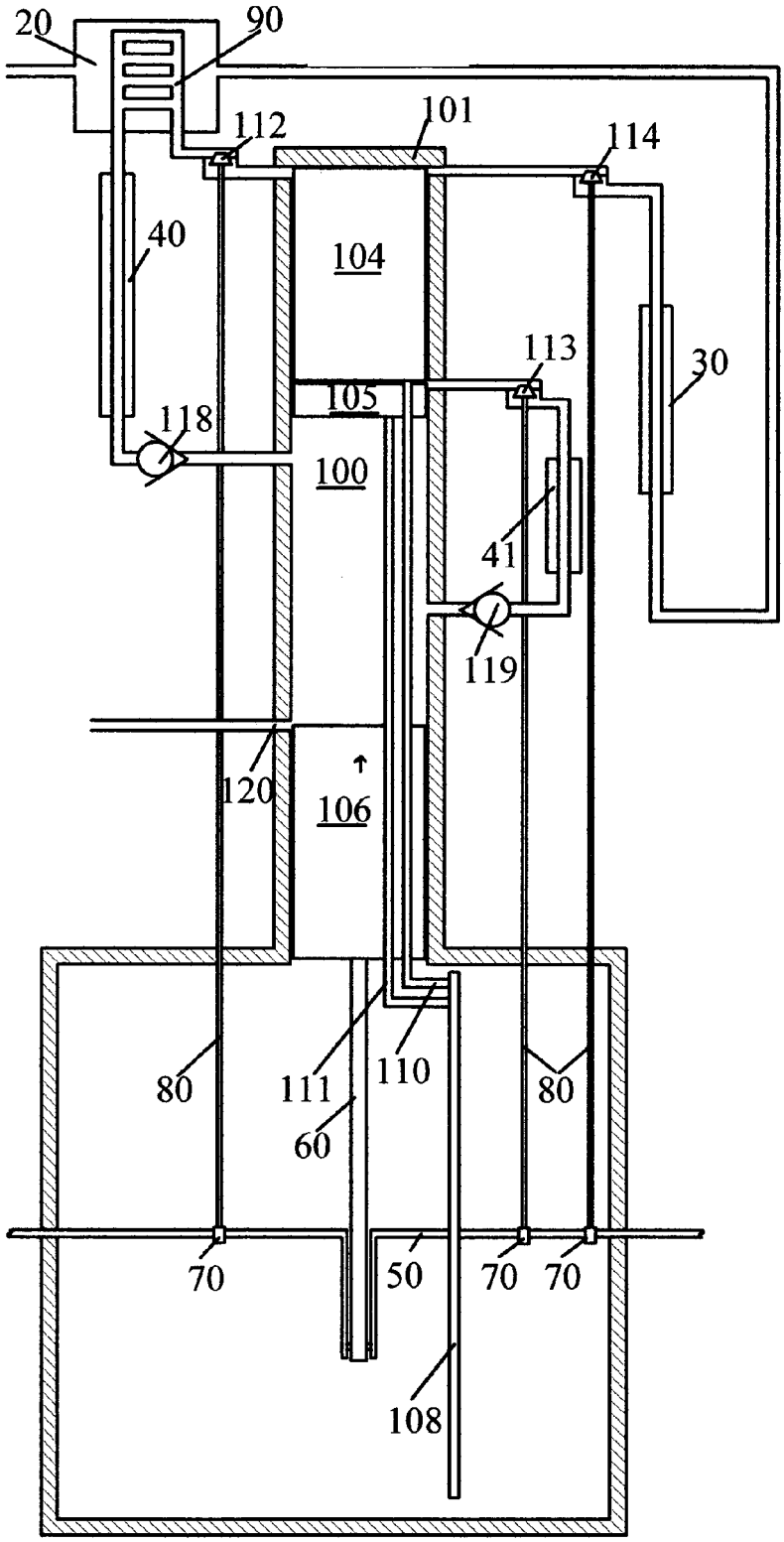
FIG. 8 shows the fourth alternate embodiment of the freezer at the end of the heating process (cooling of the load), and at the start of the additional compression process.

Description—FIG. 8—Fourth Alternate Embodiment

The fourth alternate embodiment of the freezer is the same as the preferred embodiment without the portion of the path connecting heat exchanger low-pressure side 20 to fluid inlet port 120 and pressurizing valve 130.

CONCLUSION

The advantage of the Mechanical Freezer is that it can cool the working fluid very efficiently.

I claim:

1. A two stroke, reciprocating freezer having a power input shaft, and one or more units, each unit comprising:

a) a cylinder, closed at one end and containing a movable power piston which moves in a reciprocating manner and is connected to said power input shaft by a connecting rod;

b) a displacer located within said cylinder and between said power piston and the top of said cylinder;

c) a means to move said displacer;

d) a heat sink;

e) a path from said cylinder below said displacer through said heat sink back into said cylinder above said displacer;

f) valves to isolate said path;

g) a load;

h) a valve and a port to isolate said load;

i) means to operate said valves.

2. A freezer as recited in claim 1 that contains heat exchanger low-pressure side located downstream of said load and heat exchanger high-pressure side located down stream of said heat sink.

3. A freezer as recited in claim 1 wherein said means to move said displacer is a cam attached to said power input shaft with a cam follower attached to said displacer and extending through said power piston to a groove in said cam.

4. A freezer as recited in claim 1 containing a pressurizing valve, so that the freezer can be operated pressurized.

5. A freezer as recited in claim 1 containing additional compressors, each additional compressor contains an additional displacer, an additional heat sink, a path from said cylinder below said additional displacer through said additional heat sink back into said cylinder above said additional displacer, and valves to isolate said path.

6. A freezer as recited in claim 1 wherein air is taken into the freezer and exited from the freezer.

7. A freezer as recited in claim 4 wherein said means to move said additional displacers are said cam attached to said power input shaft with cam followers attached to said additional displacers and extending through said power piston to an additional groove in said cam.

* * * * *